US005236467A

United States Patent [19]

Fritz

[11] Patent Number: 5,236,467

[45] Date of Patent: Aug. 17, 1993

[54] DOUBLE FORTIFIED HYDROCARBON AND PROCESS FOR MAKING AND USING THE SAME

[75] Inventor: James E. Fritz, Port Townsend, Wash.

[73] Assignee: Excellene Limited, Port Vila

[21] Appl. No.: 898,042

[22] Filed: Jun. 12, 1992

[51] Int. Cl.[5] ..... C10L 1/18

[52] U.S. Cl. ..... 44/438; 44/447; 48/197 FM

[58] Field of Search ..... 44/438, 447; 48/197 FM

[56] References Cited

U.S. PATENT DOCUMENTS

| | | | |
|---|---|---|---|
| 1,565,935 | 12/1925 | Harris | 48/127.3 |
| 2,281,910 | 5/1942 | Bialosky et al. | 148/23 |
| 2,411,759 | 11/1946 | Seley | 44/52 |
| 2,513,769 | 7/1950 | White | 48/197 |
| 2,908,599 | 10/1959 | Medsker | 148/23 |
| 2,951,750 | 9/1960 | White | 48/197 |
| 3,591,355 | 7/1971 | Kessler | 48/197 |
| 3,989,479 | 11/1976 | White | 48/197 |
| 4,265,638 | 5/1981 | Burke | 44/438 |
| 4,371,377 | 2/1983 | Weinberger | 44/438 |
| 4,743,272 | 5/1988 | Weinberger | 44/438 |

FOREIGN PATENT DOCUMENTS

| | | |
|---|---|---|
| 569108 | 8/1945 | United Kingdom . |
| 813981 | 5/1959 | United Kingdom . |

*Primary Examiner*—Jacqueline V. Howard
*Attorney, Agent, or Firm*—Robert W. Beach

[57] ABSTRACT

Base hydrocarbon, preferably LPG gas, is fortified with methyl ethyl ketone and methyl tertbutyl ether in an amount 0.5% to 13%, preferably 5% to 8%, of the base hydrocarbon by weight for use as torch gas, heating or motor fuel. Cutting of ferrous metal can be accomplished even under water by mixing the fortified torch gas with oxygen having a purity as low as 90%.

19 Claims, No Drawings

DOUBLE FORTIFIED HYDROCARBON AND PROCESS FOR MAKING AND USING THE SAME

BACKGROUND OF THE INVENTION

1. Field of the Invention

The present invention relates to hydrocarbons including gas for use in cutting and/or welding torches, internal-combustion engine fuels and high temperature heating gas and oil fortified by the addition of a double additive or conditioner.

2. Prior Art

Various attempts have been made heretofore to improve gas used in cutting and/or welding torches by adding an additive or a double additive to them. These prior art gases have been composed of various hydrocarbons from methane to octane and some have included propane and butane. Harris U.S. pat. No. 1,565,935, issued Dec. 15, 1925, for example, fortified a wet casinghead gas composed of methane, ethane, propane, butane and hexane by the addition of ethyl ether or methyl ether. Another patent that proposed to add ethyl or butane and propane in U.S. Pat. No. 2,513,769, issued Jul. 4, 1950 (White).

British patent specification No. 813,981, published May 27, 1959 (Oxy-Ferrolene Limited) proposes to add to hydrocarbon gas an oxygen-containing compound such as isopropyl ether, methyl isopropyl ether, methyl propyl ether, normal propyl ether, ethanol and methanol.

British patent No. 813,981 suggests the incorporation of more than one compound but does not suggest any specific double compounds. Seley U.S. Pat. No. 2,411,759, issued Nov. 26, 1946, does suggest the use of double additives, namely, ethyl oxide and benzine.

The White U.S. Pat. No. 2,951,750, issued Sep. 6, 1960, refers to the prior double additives for torch gas of dimethyl ether and benzine at column 1, lines 21 to 25, presumably as disclosed in the Seley patent, and then proposes the use of the double additive of propylene oxide and dimethyl ether at column 1, lines 55 to 62, instead of using benzine and dimethyl ether.

In addition, Kessler U.S. Pat. No. 3,591,355, issued Jul. 6, 1971, proposed the addition of a double additive to torch gas, composed of a liquid alkanol such as methanol and a mixture of alkanes such as pentane and isopentane. White U.S. Pat. No. 3,989,479, issued Nov. 2, 1976, also proposed the addition of methanol and British patent specification No. 569,108, accepted May 4, 1945, proposed the addition of ammonia. This British patent also recommended increasing the amount of propane in producer gas, water gas, Mond gas and other commercially available gas mixtures in which methane predominated.

Medsker U.S. Pat. No. 2,908,599, issued Oct. 13, 1959, stated that methyl borate and acetone had been used previously in a fuel for torch use citing U.S. Pat. No. 2,281,910. The Medsker patent proposed a mixture of methyl borate and hexane as an additive for a gaseous fuel. The Bialosky et al. U.S. Pat. No. 2,281,910, issued May 5, 1942, discloses a liquid flux containing methyl borate and a ketone, such as acetone or methyl ethyl ketone, to be subjected to a stream of acetylene, hydrogen or similar combustible gas for coating the work with boric acid or oxide.

The principal torch gas used heretofore has been acetylene which is comparatively expensive, difficult to store and to transport, requires the use of almost pure oxygen with it and forms persistently adherent scoria when used for cutting ferrous metal.

Internal-combustion engine fuels, such as gasoline, have been inclined to detonate in reciprocating piston internal-combustion engines, and it has been found that high-octane gasoline can reduce or eliminate detonation-causing combustion knock and increase power. Another expedient used to deter detonation has been the addition of antiknock material, particularly tetraethyl lead. Also, aromatic amines have been used in amounts averaging 2.6 g. of metal per gallon. Such amines are not commercially used, however, because of their higher cost than tetraethyl lead or mixed methyl ethyl lead alkyls. Also, methylcyclopentadienyl manganese tricarbonyl has been used. In addition, use of other metallic antiknock compounds have been proposed, such as thallium, selenium and tellurium organic compounds, but these have not proven to be useful.

A disadvantage of using tetraethyl lead is that the lead has been discharged into the air, and lead is physically harmful, so that its use in gasoline for internal-combustion engines has been phased out. Methyl tertiary butyl ether by itself has been used as an additive for unleaded gasoline as an octane booster and to reduce harmful emission products.

Also, methyl ethyl ketone (MEK) has been used by itself heretofore as an additive for torch gas.

SUMMARY OF THE INVENTION

A principal object of this invention is to provide fortified hydrocarbon such as torch gas having characteristics superior to those of acetylene, especially for cutting ferrous metal, and also for welding. Such object also includes providing fortified hydrocarbon having characteristics superior to those of hydrocarbon fortified only by the addition of methyl ethyl ketone.

A particular object is to provide a torch gas which will have high flame temperature and intense heating capability.

A further object is to provide torch gas that can be stored and transported easily and economically.

Another object is to provide a torch gas having a base gas which is readily available in almost the entire world, can be provided more economically and is easy to fortify for enhancing its attributes.

It is also an object to provide a torch gas enabling ferrous metal to be cut faster and cleaner.

Another object is to provide a gas that can be used by torches for cutting under water at considerable depths.

An additional object is to provide a gas that can be used for torch cutting more economically because it will combine effectively with oxygen containing a higher proportion of adulterating gases which cannot be used with acetylene.

The foregoing objects can be accomplished by utilizing liquefied petroleum gas fortified with methyl ethyl ketone and methyl tertiary butyl ether.

A further object of this invention is to provide fortified hydrocarbon for purposes other than torch gas, such as high-temperature heating gas or oil for heating industrial furnaces such as for melting metals for pouring, and blast furnaces.

This further object can be accomplished by utilizing liquid petroleum gas, natural gas or liquid hydrocarbon, such as diesel oil or fuel oil fortified with methyl ethyl ketone and methyl tertiary butyl ether.

Still another object is to fortify liquid hydrocarbon, especially gasoline, for use as an internal-combustion engine fuel to deter detonation and promote uniformity of combustion.

This still further object can be accomplished by adding to the gasoline methyl ethyl ketone and methyl tertiary butyl ether as an additive.

DETAILED DESCRIPTION

Liquefied petroleum gas (LPG) is the preferred base gas for the fortified torch gas of the present invention because of its high butane and propane content. Both the n-butane and isobutane isomers of butane are usually present in LPG, but a substantial amount of butane may have been removed from LPG sold as fuel because of the demand from industry for butane derivatives, in which case the LPG is composed largely of propane. It is, however, desirable that there be a reasonable proportion of butane in the LPG, such as from 5% to 40%.

The additive or conditioner used to fortify the base gas is methyl ethyl ketone (MEK), otherwise known as 2-butanone, having the formula $CH_3COCH_2CH_3$ and methyl tertiary butyl ether, otherwise known as methyl tert-butyl ether (MTBE) having the formula $(CH_3)_3COCH_3$. MEK is a liquid with a boiling point of 70.6 degrees C. and a specific gravity of 0.805 at 20 degrees C. At ambient temperature methyl tert-butyl ether is a colorless liquid having a boiling point of 55 degrees C. and a freezing point of −110 degrees C. and has a specific gravity of 0.74.

LPG must be stored under pressure to keep it in a liquid state, but relatively heavy pressurized storage tanks and handling equipment for LPG is commercially practical and customary.

Without being fortified, LPG mixed with oxygen is not very effective for torch cutting and welding, not nearly as effective as acetylene gas mixed with substantially pure oxygen, but by enriching the base LPG with MEK and MTBE as an additive the flame temperature is considerably increased and the heating capability is greatly improved The amount of additive used will depend on the extent to which it is desired to improve the characteristics of the base gas, but the amount would be 3% to 10% MEK and 1% to 3% MTBE of the base gas by weight, preferably 5% of MEK and 3% of MTBE.

The procedure for combining the additive with the LPG is simple. The MTBE liquid is mixed with the MEK liquid before the additive liquid is mixed with the hydrocarbon. The additive is a liquid at normal temperatures and is supplied to the storage tank in which the LPG is to be stored or transported. It is quite practical to supply the additive to standard 55-gallon drums.

The additive may be supplied in conjunction with a catalyst, preferably activated carbon in the form of powder, granules or pellets The activated carbon is amorphous, preferably having been produced from coal or petroleum coke. Alternative catalysts that can be used are platinum, cupric oxide and granular silver carried by a suitable carrier The amount of activated carbon used is not critical, but it should be placed in the bottom of a storage container to facilitate mixing of the additive with the hydrocarbon base gas when it is supplied to the container under pressure An amount of such catalyst between 1% and 5% of the weight of the additive would be satisfactory. The resulting mixture of base gas and additive or conditioner will be azeotropic so that the fortified torch gas will be homogeneous when it is released from the storage container to the torch.

In order to provide an effective cutting flame, it is necessary to supply to an acetylene torch oxygen that is in substantially pure form, such as at least 99% oxygen by volume. Satisfactory cutting temperatures can be provided by mixing with the fortified base gas of the present invention less pure oxygen such as oxygen having a purity of approximately 95%, the adulterant being nitrogen, carbon dioxide and other gas components of air. Even when oxygen of 90% purity is used, the flame temperature of base LPG of approximately 5,000 degrees F. can be raised to approximately 5,800 degrees F. to 6,000 degrees F. by use of the base LPG fortified by MEK and MTBE according to the present invention. Such impure oxygen can be produced economically by compressing air to about 4,000 psi, chilling it to minus 360 degrees F. which liquefies the air and then allowing the temperature of the liquefied air to rise gradually while venting the container to release the nitrogen component of the liquefied air which vaporizes at minus 320 degrees F. leaving the oxygen in liquid form.

In other processes for producing impure oxygen, nitrogen of the air is removed by zeolite resulting in oxygen of 90% to 95% purity.

An advantage of using the fortified base gas of the present invention over acetylene for cutting ferrous metal is that a clean precise kerf is obtained. Oxyacetylene cutting produces a hard scoria persistently adherent to the work which increases the heating required and usually must subsequently be chipped off the work. Utilization of the fortified torch gas of the present invention produces a soft friable scoria which is sloughed off the work and out of the kerf as the cutting progresses to leave a narrower clean kerf with virgin metal along opposite margins of the kerf.

A particular advantage which the fortified torch gas of the present invention has is that it can be used for flame cutting under water to a depth of 300 feet. The use of the oxyacetylene torch is limited to 20 feet under water because at pressures to which it would be necessary to subject the gas to enable it to be dispensed to the cutting torch at greater depths the acetylene will explode. Consequently, the only alternative that has been available for cutting under water at depths greater than about 20 feet prior to use of MEK as an additive to hydrocarbon gas has been the use of a carbon arc, the action of which is slow and the use of which is dangerous.

While the use of MEK has been beneficial in expediting cutting of metal and the use of MEK enhanced by the addition of tert-butyl alcohol (TBA) has increased the cutting speed from 5% to 10%, the use of MEK and MTBE in combination has increased the cutting speed to 20% to 25% faster than where MEK has been used alone as an additive and about 15% faster than the cutting speed where the MEK has been enhanced with TBA.

In addition to use of the present invention in fortified torch gas, the invention can be used for high-temperature hydrocarbon heating gas, such as LPG or natural gas and high-temperature hydrocarbon heating liquids, such as boiler fuel oil, stove oil or other oil used in such industrial processes as smelting or other metal melting such as required for foundry casting, or for steam generating. For such purposes, the additive of MEK and MTBE can be within the range of 2% to 10% of the hydrocarbon by weight. If the amount of additive is greater than 5%, a catalyst such as powdered activated carbon should be used to facilitate thorough mixing of the additive with the hydrocarbon.

Use of hydrocarbon gas such as LPG for soldering, brazing or light metal cutting is rendered more effective if the additive including MEK and MTBE is mixed with the gas. For such use it is preferable to use less additive than in the case of torch gas for cutting or welding thick metal. For soldering, brazing or light cutting, an amount of additive within the range of 2% to 5% by weight is adequate, and such an amount can be mixed sufficiently intimately with the hydrocarbon gas without the use of a catalyst.

Another use of MEK and MTBE additive is for fortifying internal-combustion engine fuel, such as automotive gasoline, aviation gasoline or diesel oil. For such use the additive functions as an antiknock agent as well as improving the uniformity of combustion and accelerating the rate of combustion, which consequently enhances the power-producing characteristics of the fuel.

For internal-combustion engine fuel use, the range of additive used would be 0.5% to 6% of the hydrocarbon by weight but preferably within the range of 1% to 4% by weight.

It should be emphasized that MEK is an effective additive for hydrocarbon without MTBE, but not as effective, and that MTBE without MEK is not an effective additive.

I claim:

1. Fortified hydrocarbon comprising a mixture of a major portion by weight of hydrocarbon base and a minor portion by weight of MEK (methyl ethyl ketone) and MTBE (methyl tertiary butyl ether or methyl tert-butyl ether) as an additive.

2. The hydrocarbon defined in claim 1, in which the amount of additive is within the range of 0.5% to 13% of the hydrocarbon base by weight.

3. The hydrocarbon defined in claim 1, in which the hydrocarbon base is gas.

4. The hydrocarbon defined in claim 1, in which the hydrocarbon is torch gas and the hydrocarbon base is gas.

5. The torch gas defined in claim 4, in which the amount of additive is within the range of 3% to 13% of the hydrocarbon base gas by weight.

6. The torch gas defined in claim 5, in which the amount of additive is within the range of 6% to 9% of the hydrocarbon base gas by weight.

7. The torch gas defined in claim 5, in which the additive includes an amount of MEK from 3% to 10% of the hydrocarbon base by weight and an amount of MTBE from 1% to 3% of the hydrocarbon base by weight.

8. The torch gas defined in claim 6, in which the additive includes an amount of MEK from 4% to 6% of the hydrocarbon base by weight and an amount of MTBE from 2% to 3% of the hydrocarbon base by weight.

9. The torch gas defined in claim 3, in which the base gas is LPG (liquid petroleum gas).

10. The hydrocarbon defined in claim 1, in which the hydrocarbon base is natural gas.

11. The hydrocarbon defined in claim 1, in which the hydrocarbon base is liquid at ambient temperature.

12. The hydrocarbon defined in claim 11, in which the hydrocarbon base is gasoline.

13. The hydrocarbon defined in claim 11, in which the amount of additive includes an amount of MEK from 1% to 5% of the hydrocarbon base by weight and an amount of MTBE from 0.5% to 2% of the hydrocarbon base by weight.

14. The hydrocarbon defined in claim 11, in which the amount of additive includes an amount of MEK from 2% to 3% of the hydrocarbon base by weight and an amount of MTBE from 1% to 1.5% of the hydrocarbon base by weight.

15. The process of making fortified hydrocarbon which comprises supplying additive including MEK and MTBE and supplying a hydrocarbon base for mixing with the additive.

16. The process defined in claim 15, including supplying LPG as the hydrocarbon base.

17. The process defined in claim 16, including supplying additive within the range of 0.5% to 13% of the base hydrocarbon by weight.

18. The process of heating which comprises burning a base hydrocarbon fortified by the addition of MEK and MTBE.

19. The process of torch cutting ferrous metal under water which comprises supplying to a torch deeply submerged in water a mixture of oxygen with torch gas fortified by MEK and MTBE.

* * * * *